US010344479B2

(12) United States Patent
Nugent et al.

(10) Patent No.: US 10,344,479 B2
(45) Date of Patent: Jul. 9, 2019

(54) COMPOSITE BUILDING PANEL HAVING INTEGRATED FURRING MEMBERS

(71) Applicant: SYNTHEON HOLDINGS S.P.A., Santiago (CL)

(72) Inventors: Dennis Nugent, South Park, PA (US); Peter A Humphrey, Cranberry Two, PA (US); Jeremy S Urban, Pittsburgh, PA (US)

(73) Assignee: SYNTHEON HOLDINGS S.P.A., Santiago (CL)

( * ) Notice: Subject to any disclaimer, the term of this patent is extended or adjusted under 35 U.S.C. 154(b) by 0 days.

(21) Appl. No.: 15/737,095

(22) PCT Filed: Jun. 17, 2016

(86) PCT No.: PCT/US2016/038086
§ 371 (c)(1),
(2) Date: Dec. 15, 2017

(87) PCT Pub. No.: WO2016/205656
PCT Pub. Date: Dec. 22, 2016

(65) Prior Publication Data

US 2018/0171632 A1 Jun. 21, 2018

Related U.S. Application Data

(60) Provisional application No. 62/182,089, filed on Jun. 19, 2015.

(51) Int. Cl.
*E04C 2/38* (2006.01)
*E04C 2/06* (2006.01)
(Continued)

(52) U.S. Cl.
CPC ..... *E04C 2/388* (2013.01); *E04C 2/06* (2013.01); *E04C 2/205* (2013.01); *E04C 2/22* (2013.01);
(Continued)

(58) Field of Classification Search
CPC ... E04C 2/388; E04C 2/38; E04C 2/22; E04C 2/205; E04C 2/06; E04F 13/0805; E04B 2001/2481
See application file for complete search history.

(56) References Cited

U.S. PATENT DOCUMENTS 4,219,978 A 9/1980 Brown
5,226,276 A 7/1993 Cahill
(Continued)

OTHER PUBLICATIONS

International Search Report dated Sep. 7, 2016 issued in corresponding International Application No. PCT/US2016/038086.

*Primary Examiner* — Adriana Figueroa
(74) *Attorney, Agent, or Firm* — Nath, Goldberg & Meyer; Joshua B. Goldberg; Tanya E. Harkins

(57) ABSTRACT

A composite building panel includes: a central body comprised of an expanded polymer matrix having a first face and an opposing second face, a top surface and an opposing bottom surface, and a first side surface and an opposing second side surface; and a furring member extending horizontally across the central body between the first side surface and the second side surface proximate to the top surface. The furring member comprises: a bottom portion having at least one expansion hole such that the expanded polymer matrix extends therethrough, thereby embedding the bottom portion in the expanded polymer matrix; a first side portion extending perpendicularly from the bottom portion; and a second side portion extending perpendicularly from the bottom surface. One of the side portions extends
(Continued)

from the bottom portion beyond the top surface of the central body.

18 Claims, 10 Drawing Sheets

(51) Int. Cl.
*E04C 2/22* (2006.01)
*E04C 2/20* (2006.01)
*E04F 13/08* (2006.01)
*E04B 1/24* (2006.01)

(52) U.S. Cl.
CPC .. *E04F 13/0805* (2013.01); *E04B 2001/2481* (2013.01)

(56) References Cited

U.S. PATENT DOCUMENTS 5,822,940 A * 10/1998 Carlin ..... E04B 2/7453 52/479
5,842,276 A * 12/1998 Asher ..... B26D 1/553 29/897.32
5,893,248 A * 4/1999 Beliveau ..... E04B 1/80 52/309.16
5,943,775 A * 8/1999 Lanahan ..... B26D 1/553 264/142
6,298,622 B1 * 10/2001 Cretti ..... B29C 45/14311 52/309.12
7,666,258 B2 * 2/2010 Guevara ..... C04B 16/08 106/724
8,109,055 B2 * 2/2012 Miller ..... E04B 1/14 52/220.7
8,234,833 B2 * 8/2012 Miller ..... E04B 7/22 52/220.7
8,656,672 B2 * 2/2014 Quinn ..... E04B 1/7629 52/309.2
8,726,594 B2 * 5/2014 Salazar ..... E04B 5/043 52/309.1
8,752,348 B2 * 6/2014 Bowman ..... E04B 5/043 52/309.1
8,833,025 B2 * 9/2014 Krause ..... E04F 13/0828 52/506.08
9,273,462 B2 * 3/2016 Black ..... E04C 2/22
2002/0062607 A1 5/2002 Hota et al.
2007/0039266 A1 * 2/2007 Cretti ..... E04B 5/026 52/340
2009/0056255 A1 * 3/2009 Barton ..... E04B 1/14 52/309.7
2010/0095621 A1 * 4/2010 Pumper ..... E04B 1/80 52/404.4
2014/0059959 A1 * 3/2014 Salazar ..... E04B 5/043 52/309.13
2014/0260031 A1 * 9/2014 Salazar ..... E04C 2/22 52/309.16
2016/0194875 A1 * 7/2016 Krause ..... E04F 13/0828 52/309.4

* cited by examiner

COMPOSITE BUILDING PANEL HAVING INTEGRATED FURRING MEMBERS

This is a National Phase Application filed under 35 U.S.C. 371 as a national stage of PCT/US2016/038086, filed Jun. 17, 2016, an application claiming the benefit of U.S. Provisional Application No. 62/182,089, filed Jun. 19, 2015, the content of each of which is hereby incorporated by reference in its entirety.

BACKGROUND OF THE INVENTION

Field of the Invention

The present invention is generally directed to pre-formed building panels and, more specifically, to pre-formed building panels that include a furring member embedded in an expanded polymer matrix.

Description of Related Art

A typical technique for insulating a building having wall assemblies erected using studs is to provide insulation in the cavity between the studs. However, such a technique can create a thermally inefficient wall due to thermal bridging through the studs. The thermal bridging creates concerns for condensation within the wall, potentially causing mold or mildew problems, and reducing the indoor air quality. In addition, the poor thermal performance resulting from the thermal bridging creates inefficient heating and cooling within the building, which increases energy usage, and can result in poor thermal comfort for the occupants.

In order to solve this problem, builders have utilized continuous insulation provided outboard of the studs and girts extending perpendicularly to the studs for supporting the insulation and cladding on the studs. Such a technique also leads to deficiencies. For instance, since the girts interrupt the rigid insulation, numerous thermal bridges are created. While this method may improve the thermal performance, thermal bridging still occurs, including the thermal bridging resulting from the girts and the fasteners required for the cladding attachment. Additionally, the positive connection of the claddings can be complex while fastening thru the continuous insulation. From an installation perspective, this solution requires multiple steps and is highly labor intensive.

Accordingly, a need exists for a building panel that provides insulation while also reducing thermal bridging and provides positive attachment for the cladding in a highly constructible method with high labor productivity.

SUMMARY OF THE INVENTION

A composite building panel is provided that comprises: a central body comprised of an expanded polymer matrix having a first face and an opposing second face, a top surface and an opposing bottom surface, and a first side surface and an opposing second side surface; and a furring member extending horizontally across the central body between the first side surface and the second side surface proximate to the top surface. The furring member comprises: a bottom portion having at least one expansion hole such that the expanded polymer matrix extends therethrough, thereby embedding the bottom portion in the expanded polymer matrix; a first side portion extending perpendicularly from the bottom portion; and a second side portion extending perpendicularly from the bottom surface. At least one of the first side portion and the second side portion of the furring member extends from the bottom portion of the furring member beyond the top surface of the central body.

The first side portion may extend along the first face of the central body and the second side portion may extend along the second face of the central body or the first side portion may be embedded in the central body behind the first face of the central body and the second side portion may extend along the second face of the central body. The first side portion and the second side portion may extend in directions that are substantially parallel to one another and the bottom portion may extend in a direction that is substantially perpendicular to the directions in which the first side portion and the second side portion extend. The first side portion may extend away from the bottom portion in a direction that is substantially the same as the direction in which the second side portion extends away from the bottom portion or the first side portion may extend away from the bottom portion in a direction that is substantially opposite to the direction in which the second side portion extends away from the bottom portion.

The composite building panel of the present invention provides a lightweight and easy to install building panel that reduced the need for cavity insulation while also reducing thermal bridging. The reduced thermal bridging minimizes the potential for condensation in the wall, helping to maintain the indoor air quality while allowing for efficient heating and cooling within the building due to the improved thermal performance, thereby increasing the thermal comfort of the occupants. The of complimentary grooves and projections enhances the constructability while providing for a tighter seal to mitigate air, water, vapor, and thermal intrusion/transmission. The integral furring member provides for positive structural attachment of claddings while minimizing the thermal impact from the fasteners. In addition, by integrating the furring member within the central body to make an integral panel the number of installation steps is reduced and improved labor productivity can be achieved.

In one embodiment, the top surface of the central body may comprise one of a groove and a projection and the bottom surface may comprise one of a complimentary groove and a complimentary projection that facilitates a groove and projection union between a first central body and a second central body to form one or more combined composite building panels.

The bottom portion of the furring member may comprise a plurality of expansion holes. In addition, the side portion of the furring member that extends from the bottom portion of the furring member beyond the top surface of the central body may include a plurality of holes provided along the length thereof for fastening or attachment purposes.

In one embodiment of the furring member, the plurality of expansion holes may be positioned along the length of the bottom portion of the furring member and may comprise a first row of equally spaced, elongated holes and a second row of equally spaced, elongated holes. The holes of the second row may be offset with respect to the holes of the first and third rows. In another embodiment of the furring member, the plurality of expansion holes may be positioned along the length of the bottom portion of the furring member and may comprise a first row of equally spaced, elongated holes, a second row of equally spaced, elongated holes and a third row of equally spaced, elongated holes. The holes of the second row may be offset with respect to the holes of the first and third rows. In yet another embodiment, the plurality of expansion holes may be positioned along the length of the bottom portion of the furring member and may comprise a first row of equally spaced, elongated holes; a second row of equally spaced, elongated holes; a third row of equally spaced, elongated holes; and a fourth row of equally spaced, elongated holes. The holes of the second and fourth rows may be offset with regard to the holes of the first and third rows.

Also provided is a composite building panel that comprises: a central body comprised of an expanded polymer matrix; and a furring member extending horizontally across the central body. The furring member comprises: a bottom portion embedded within the central body having at least one expansion hole such that the expanded polymer matrix extends therethrough and a side portion extending perpendicularly from the bottom portion outside of the central body to a position above a top surface of the central body.

In addition, provided is a method of constructing a building that comprises: providing a foundation having a series of foundation walls having top surfaces; providing a plurality of composite building panels; providing metal studs extending from the top surfaces of the foundation walls; providing a plurality of composite building panels, and stacking the plurality of composite building panels on top of each other on at least some of the top surfaces of the foundation walls until a desired height of a combined composite building panel is reached. Each of the panels comprises: a central body comprised of an expanded polymer matrix having a first face and an opposing second face, a top surface and an opposing bottom surface, and a first side surface and an opposing second side surface; and a furring member extending horizontally across the central body between the first side surface and the second side surface proximate to the top surface. The furring member comprises: a bottom portion having at least one expansion hole such that the expanded polymer matrix extends therethrough, thereby embedding the bottom portion in the expanded polymer matrix; a first side portion extending perpendicularly from the bottom portion; and a second side portion extending perpendicularly from the bottom surface. At least one of the first side portion and the second side portion of the furring member extends from the bottom portion of the furring member beyond the top surface of the central body and the metal studs are connected to the at least one of the first side portion and the second side portion of the furring member using fasteners. The top surface of the central body of each of the plurality of composite building panels may include one of a groove and a projection and the bottom surface comprises one of a complimentary groove and a complimentary projection that facilitates a groove and projection union between a first central body and a second central body to form the combined composite building panel.

These and other features and characteristics of the device of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the device of the present disclosure. As used in the specification and the claims, the singular form of "a", "an", and "the" include plural referents unless the context clearly dictates otherwise.

In one embodiment, the central body is comprised of a portion above the furring member and a portion below the furring member that are joined to the integral furring member and to each other by an adhesion process creating the composite building panel. The adhesive would extend through the expansion holes to maintain the insulating properties and reduce the thermal bridging.

DESCRIPTION OF THE INVENTION

Figure 1:
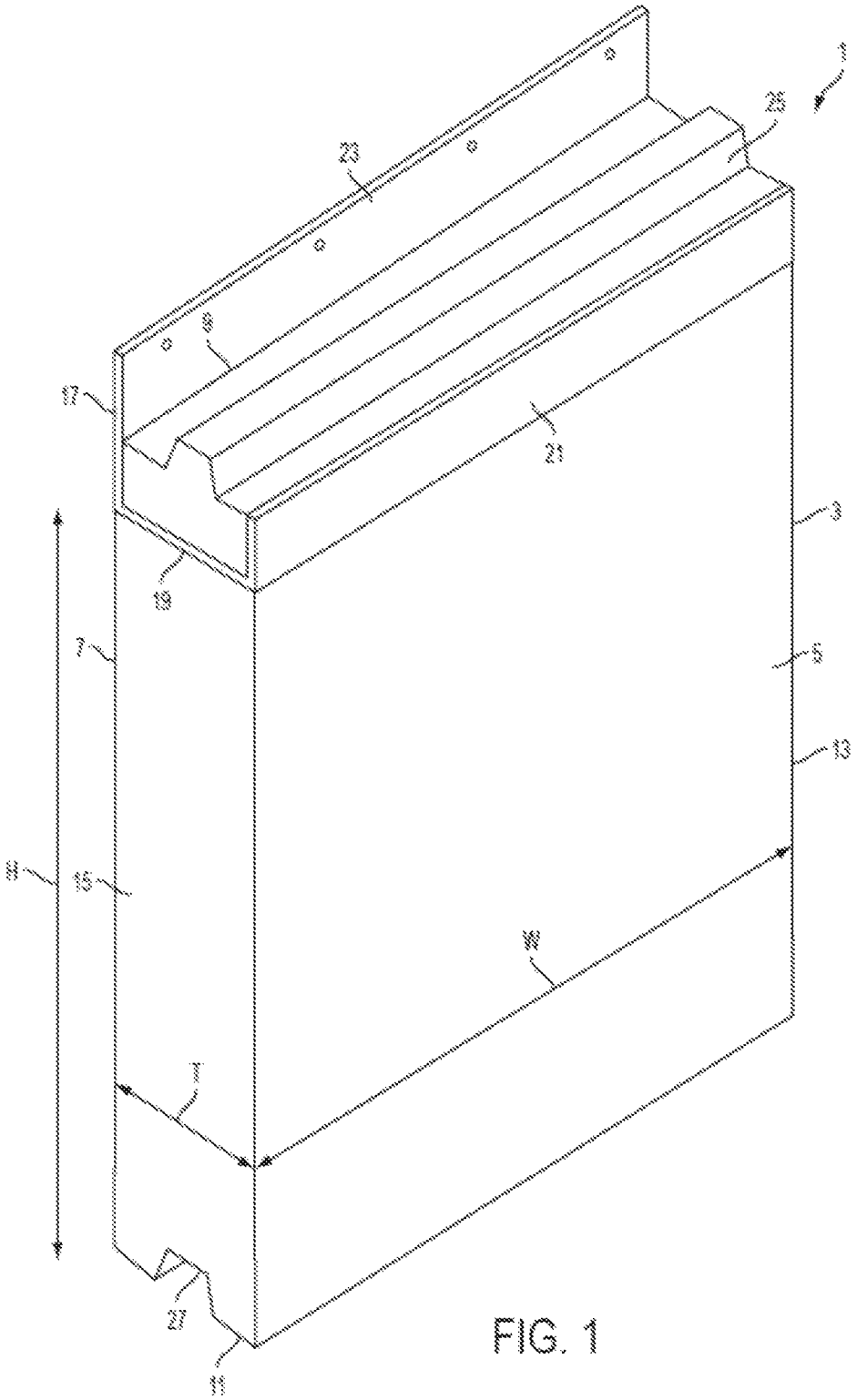
FIG. 1 is a perspective view of a building panel in accordance with the present invention.

For purposes of the description hereinafter, the terms "upper", "lower", "right", "left", "vertical", "horizontal", "top", "bottom", "lateral", "longitudinal", and derivatives thereof, shall relate to the device of the present disclosure as it is oriented in the drawing figures. However, it is to be understood that the device of the present disclosure may assume various alternative variations, except where expressly specified to the contrary. It is also to be understood that the specific devices illustrated in the attached drawings, and described in the following specification, are simply exemplary embodiments of the device of the present disclosure. Hence, specific dimensions and other physical characteristics related to the embodiments disclosed herein are not to be considered as limiting.

Other than where otherwise indicated, all numbers or expressions referring to quantities, distances, or measurements, etc. used in the specification and claims are to be understood as modified in all instances by the term "about." Accordingly, unless indicated to the contrary, the numerical parameters set forth in the following specification and attached claims are approximations that can vary depending upon the desired properties, which the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective measurement methods.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

With reference to FIG. 1, a composite building panel 1 comprises: a central body 3 comprised of an expanded polymer matrix having a first face 5 and an opposing second face 7, a top surface 9 and an opposing bottom surface 11, and a first side surface 13 and an opposing second side surface 15. The composite building panel 1 also comprises a furring member 17 extending horizontally across the central body 3 between the first side surface 13 and the second side surface 15 proximate to the top surface 9.

The furring member 17 comprises: a bottom portion 19 having at least one expansion hole (as will be described in greater detail hereinafter with reference to FIGS. 5*a*-13) such that the expanded polymer matrix extends therethrough, thereby embedding the bottom portion 19 in the expanded polymer matrix; a first side portion 21 extending perpendicularly from the bottom portion 19 along the first face 5; and a second side portion 23 extending perpendicularly from the bottom portion 19 along the second face 7. The second side portion 23 of the furring member 17 extends from the bottom portion 19 of the furring member 17 beyond the top surface 9 of the central body 3.

As used herein, the term "expandable polymer matrix" refers to a polymeric material in particulate or bead form that can be impregnated with a blowing agent or through a chemical reaction creating an expanding agent such that when the particulates and/or beads are placed in a mold and heat is applied thereto, evaporation of the blowing/expanding agent (as described below) effects the formation of a cellular structure and/or an expanding cellular structure in the particulates and/or beads and the outer surfaces of the particulates and/or beads fuse together to form a continuous mass of polymeric material conforming to the shape of the mold.

As used herein, the term "polymer" is meant to encompass, without limitation, homopolymers, copolymers and graft copolymers.

The expanded polymer matrix makes up the expanded polymer body, panels and/or forms described herein below. The expanded polymer matrix is typically molded from expandable thermoplastic and/or thermoset particles. These expandable thermoplastic particles are made from any suitable thermoplastic homopolymer or copolymer and thermoset matrix former. Particularly suitable for use are homopolymers derived from vinyl aromatic monomers including styrene, isopropylstyrene, alpha-methylstyrene, nuclear methylstyrenes, chlorostyrene, tert-butylstyrene, and the like, as well as copolymers prepared by the copolymerization of at least one vinyl aromatic monomer as described above with one or more other monomers, non-limiting examples being divinylbenzene, conjugated dienes (non-limiting examples being butadiene, isoprene, 1,3- and 2,4-hexadiene), alkyl methacrylates, alkyl acrylates, acrylonitrile, and maleic anhydride, wherein the vinyl aromatic monomer is present in at least 50% by weight of the copolymer. In an embodiment of the invention, styrenic polymers are used, particularly polystyrene. However, other suitable polymers can be used, such as polyolefins (e.g., polyethylene, polypropylene), polycarbonates, polyphenylene oxides, polyurethanes, polyisocyanurates, phenolics, and mixtures thereof.

As used herein, the terms "(meth)acrylic" and "(meth) acrylate" are meant to include both acrylic and methacrylic acid derivatives, such as the corresponding alkyl esters often referred to as acrylates and (meth)acrylates, which the term "(meth)acrylate" is meant to encompass.

In various embodiments of the invention, the expandable thermoplastic particles and/or thermoset particles are expandable polystyrene (EPS) particles or polyolefins (e.g., polyethylene, polypropylene), polycarbonates, polyphenylene oxides, polyurethanes, polyisocyanurates, phenolics, and mixtures thereof. These particles can be in the form of beads, granules, or other particles convenient for the expansion and molding operations or liquids injected into suitable molds and expanded. Particles polymerized in an aqueous suspension process are essentially spherical and are useful for molding the expanded polymer body, panels and/or forms described herein below. These particles can be screened so that their size ranges from about 0.008 to about 0.15 inch (0.20 mm to about 3.81 mm) prior to expansion.

The expandable thermoplastic particles can be impregnated using any conventional method with a suitable blowing agent. As a non-limiting example, the impregnation can be achieved by adding the blowing agent to the aqueous suspension during the polymerization of the polymer, or alternatively by re-suspending the polymer particles in an aqueous medium and then incorporating the blowing agent as taught in U.S. Pat. No. 2,983,692. Any gaseous material or material which will produce gases on heating can be used as the blowing agent. Conventional blowing agents include aliphatic hydrocarbons containing 4 to 6 carbon atoms in the molecule, such as butanes, pentanes, hexanes, and the halogenated hydrocarbons, e.g., CFC's and HCFC's, which boil at a temperature below the softening point of the polymer chosen. Mixtures of these aliphatic hydrocarbon blowing agents can also be used.

Other foaming mechanisms that may be employed include, but are not limited to, azo (nitrogen compound forming), sodium bicarbonate, nitrogen injection, $CO_2$ injection, and water blown.

Alternatively, water can be blended with these aliphatic hydrocarbons, blowing agents or water can be used as the sole blowing agent as taught in U.S. Pat. Nos. 6,127,439; 6,160,027; and 6,242,540 in these patents, water-retaining agents are used. The weight percentage of water for use as the blowing agent can range from 1 to 20%. The texts of U.S. Pat. Nos. 6,127,439, 6,160,027 and 6,242,540 are incorporated herein by reference.

The impregnated thermoplastic particles are generally pre-expanded to a density of at least 0.1 $lb/ft^3$, in some cases at least 0.25 $lb/ft^3$, in other cases at least 0.5 $lb/ft^3$, in some situations at least 0.75 $lb/ft^3$, in other situations at least 1 lb/ft$^3$, and in some instances at least about 2 lb/ft$^3$. Also, the density of the impregnated pre-expanded particles can be up to 12 lb/ft$^3$, in some cases up to 10 lb/ft$^3$, and in other cases up to 5 lb/ft$^3$. The density of the impregnated pre-expanded particles can be any value or range between any of the values recited above. The pre-expansion step is conventionally carried out by heating the impregnated beads via any conventional heating medium, such as steam, hot air, hot water, or radiant heat. One generally accepted method for accomplishing the pre-expansion of impregnated thermoplastic particles is taught in U.S. Pat. No. 3,023,175.

The impregnated thermoplastic particles can be foamed cellular polymer particles as taught in U.S. Patent Publication No. 2002/0117769, the teachings of which are incorporated herein by reference. The foamed cellular particles can be polystyrene that are pre-expanded and contain a volatile blowing agent at a level of less than 10.0 wt %, in some cases ranging from about 2.0 wt % to about 10.0 wt %, and in other cases ranging from about 2.5 wt % to about 3.5 wt % based on the weight of the polymer.

An interpolymer of a polyolefin and in situ polymerized vinyl aromatic monomers that can be included in the expandable thermoplastic resin according to various embodiments of the present invention is disclosed in U.S. Pat. Nos. 4,303,756 and 4,303,757 and U.S. Application Publication No. 2004/0152795, the relevant portions of which are herein incorporated by reference. Non-limiting examples of interpolymers that can be used in the present invention include those available under the trade name ARCEL®, available from NOVA Chemicals Inc., Pittsburgh, Pa. and PIOCELAN®, available from Sekisui Plastics Co., Ltd., Tokyo, Japan.

The expanded polymer matrix can include customary ingredients and additives, such as pigments, dyes, colorants, plasticizers, mold release agents, stabilizers, ultraviolet light absorbers, mold prevention agents, antioxidants, and so on. Typical pigments include, without limitation, inorganic pigments such as carbon black, graphite, expandable graphite, zinc oxide, titanium dioxide, and iron oxide, as well as organic pigments such as quinacridone reds and violets and copper phthalocyanine blues and greens.

In one embodiment of the invention the pigment is carbon black, a non-limiting example of such a material is EPS SILVER® pigment, available from NOVA Chemicals Inc., Pittsburgh, Pa.

In another embodiment of the invention the pigment is graphite, a non-limiting example of such a material is NEOPOR® pigment, available from BASF Aktiengesellschaft Corp., Ludwvigshafen am Rhein, Germany.

When materials such as carbon black and/or graphite are included in the polymer particles, improved insulating properties, as exemplified by higher R values for materials containing carbon black or graphite (as determined using ASTM-C578), are provided. As such, the R value of the expanded polymer particles containing carbon black and/or graphite or materials made from such polymer particles have been shown to be at least 5% higher than observed for particles or resulting articles that do not contain carbon black and/or graphite.

The pre-expanded particles or "pre-puff" are heated in a closed mold in the semi-continuous or continuous molding process described below to form the pre-formed building panels according to various embodiments of the present invention.

In some embodiments, portions of the central body 3 can further comprise materials in addition to the expanded polymer matrix, as nonlimiting examples ultraviolet (UV) stabilizers, heat stabilizers, flame retardants, structural enhancements, biocides, and combinations thereof.

With continued reference to FIG. 1, central body 3 has a width W. The central body 3 can be manufactured in a variety of different widths that would facilitate its safe handling and minimal damage during shipping and installation thereof. For instance, the width W of the central body 3 may be about 12-240 inches. The height H of central body 3 can be any height that allows for the safe handling and minimal damage to the central body 3 during shipping and installation. For instance, the width H of the central body 3 may be about 12-48 inches. In various embodiments, the height H of central body 3 is about 24 inches. The thickness T, measured as the distance from the first face 5 to second face 7, of the central body 3 may be between about 2 and 6 inches. One skilled in the art will appreciate that the central body 3 could be provided in other widths, heights, and thicknesses without departing from the spirit and scope of the present invention.

Still referring to FIG. 1, the central body 3 further includes a top surface 9 having a male "tongue" end or edge 25 and a bottom surface 11 having a female "groove" end or edge 27, that facilitate a "tongue and groove" union of two matching panels. Typically the tongue and groove union provides a flat surface at the union to allow for easy application of sealing tape to seal the union or joint if desired. The male "tongue" end or edge 25 may have a generally pyramidal shape that corresponds with the shape of the female "groove" end or edge 27, thereby providing a smooth flat surface when two panels are interconnected.

Figure 2:
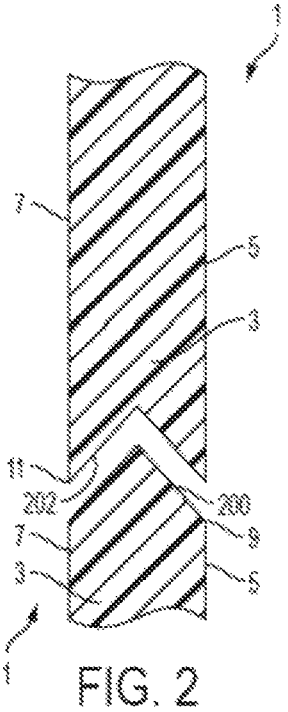
FIGS. 2-4 are cross-sectional views of portions of building panels in accordance with the present invention illustrating various embodiments of complimentary grooves and projections provided at the top and bottom surfaces of the panels.
Figure 3:
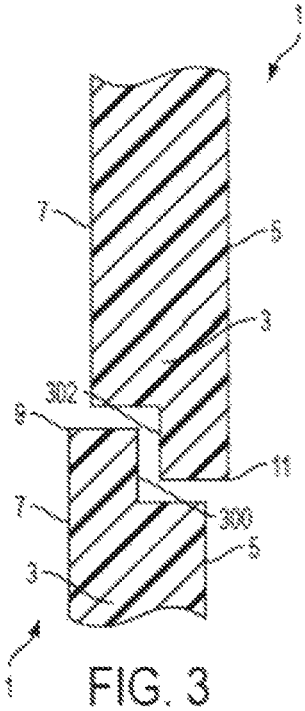
Figure 4:
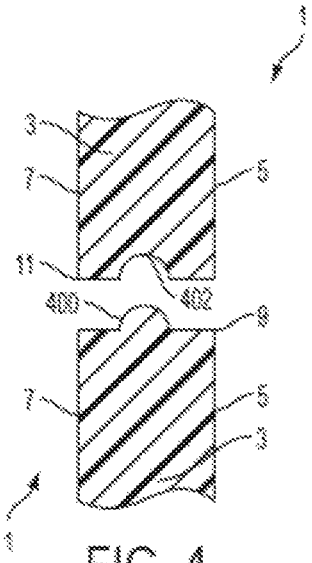

With reference to FIGS. 2-4, and with continuing reference to FIG. 1, various shapes and configurations for the complimentary grooves and projections provided at the top and bottom surfaces of the panels may be provided without departing from the spirit and scope of the present invention. For instance, as shown in FIG. 2, the top surface 9 of the central body 3 may include a protruding portion 200 and the bottom surface 11 includes a corresponding recessed portion 202. The protruding portion 200 may have a generally triangular cross-sectional shape that corresponds with a shape of the corresponding recessed portion. The protruding portion 200 is designed to align with a corresponding recessed portion when two panels 1 are interconnected, thereby providing a substantially smooth flat wall surface.

Referring now to FIG. 3, the top surface 9 of the central body 3 may include a protruding portion 300 adjacent to the second face 7 and the bottom surface 11 may include a corresponding protruding portion 302 positioned adjacent to first face 5. Each of the protruding portions may have a generally rectangular shape. The protruding portion 300 is designed to adjoin with the protruding portion 302 when two panels 1 are interconnected, thereby providing a substantially smooth flat wall surface.

Referring now to FIG. 4, the top surface 9 of the central body 3 may include a protruding portion 400 and the bottom surface 11 includes a corresponding recessed portion 402. The protruding portion 400 may have a generally semicircular shape that corresponds with a shape of the corresponding recessed portion 402. The protruding portion 400 is designed to align with a corresponding recessed portion 402 when two panels 1 are interconnected, thereby providing a substantially smooth flat wall surface.

Various other configurations for the complimentary grooves and projections not specifically discussed herein may also be utilized.

In addition, the various configurations for the complimentary grooves and projections discussed above may also be included on first side surface 13 and the opposing second side surface 15 of the central body 3 to facilitate a "tongue and groove" union of two matching panels 1 along the side surfaces 13, 15 thereof.

As discussed hereinabove, various embodiments of the present invention further include a furring member 17 extending along the width of the panel 1 proximate to the top surface 9 of the panel 1 to provide a connection to the steel studs of a building structure. The furring member 17 is embedded in the expanded polymer matrix due to the expanded polymer matrix passing through expansion holes provided in the furring member 9, thereby minimizing thermal bridging.

The furring members used in various embodiments of the invention can be made of any suitable material. Suitable materials include, but are not limited to metals, construction grade plastics, composite materials, ceramics, combinations thereof, and the like. Suitable metals include, but are not limited to, aluminum, steel, stainless steel, tungsten, molybdenum, iron and alloys and combinations of such metals. In various particular embodiments of the invention, the furring members are made of a light gauge metal of about 12 to 20 gauge and, in some cases, about 16 to 18 gauge. Any of these materials may be coated with suitable coating to improve corrosion resistance, thermal performance, and/or fire performance. Such coatings include, but are not limited to, hot dipped galvanization, zinc rich paints, intumescent paints, epoxies and ceramics.

Suitable construction grade plastics include, but are not limited to reinforced thermoplastics, thermoset resins, and reinforced thermoset resins. Thermoplastics include polymers and polymer foams made up of materials that can be repeatedly softened by heating and hardened again on cooling. Suitable thermoplastic polymers include, but are not limited to homopolymers and copolymers of styrene, homopolymers and copolymers of C2 to C20 olefins, C4 to C20 dienes, polyesters, polyamides, homopolymers and copolymers of C2 to C20 (meth)acrylate esters, polyetherimides, polycarbonates, polyphenylethers, polyvinylchlorides, polyurethanes, and combinations thereof.

Suitable thermoset resins are resins that when heated to their cure point, undergo a chemical cross-linking reaction causing them to solidify and hold their shape rigidly, even at elevated temperatures. Suitable thermoset resins include, but are not limited to alkyd resins, epoxy resins, diallyl phthalate resins, melamine resins, phenolic resins, polyester resins, urethane resins, and urea, which can be crosslinked by reaction, as non-limiting examples, with diols, triols, polyols, and/or formaldehyde.

Reinforcing materials that can be incorporated into the thermoplastics and/or thermoset resins include, but are not limited to carbon fibers, aramid fibers, glass fibers, metal fibers, fiberglass, carbon black, graphite, clays, calcium carbonate, titanium dioxide, woven fabric or structures of the above-referenced fibers, and combinations thereof.

With reference to FIGS. 5*a*-7, the furring member 17 includes: a bottom portion 19 having a plurality of expansion holes 29 such that the expanded polymer matrix extends therethrough, thereby embedding the bottom portion 19 in the expanded polymer matrix; a first side portion 21*a*, 21*b* extending perpendicularly from the bottom portion 19; and a second side portion 23 extending perpendicularly from the bottom portion 19.

The first side portion 21*a*, 21*b* and the second side portion 23 extend in directions that are substantially parallel to one another and the bottom portion 19 extends in a direction that is substantially perpendicular to the directions in which the first side portion 21*a*, 21*b* and the second side portion 23 extend. In one embodiment, shown in FIG. 5*a*, the first side portion 21*a* extends away from the bottom portion 19 in a direction that is substantially the same as the direction in which the second side portion 23 extends away from the bottom portion 19 such that the furring member 17 has a generally J-shaped cross section. In another embodiment, shown in FIG. 5*b*, the first side portion 21*b* extends away from the bottom portion 19 in a direction that is substantially opposite to the direction in which the second side portion 23 extends away from the bottom portion 19 such that the furring member 17 has a generally Z-shaped cross section.

Figure 5A:
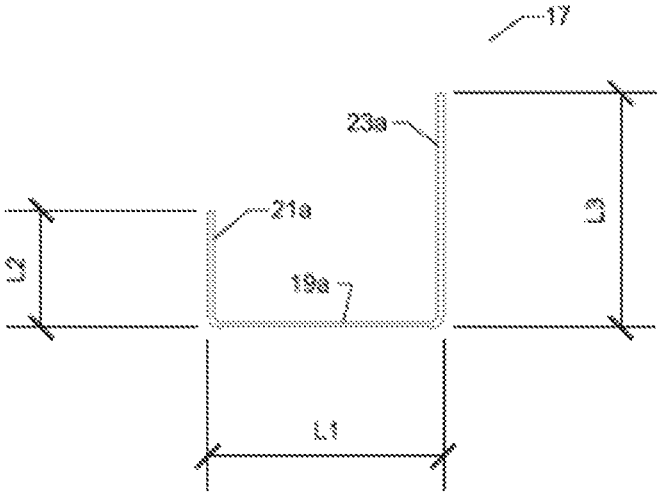
FIG. 5*a* is a cross-sectional view of an embodiment of a furring member of the building panel of FIG. 1.
Figure 5B:
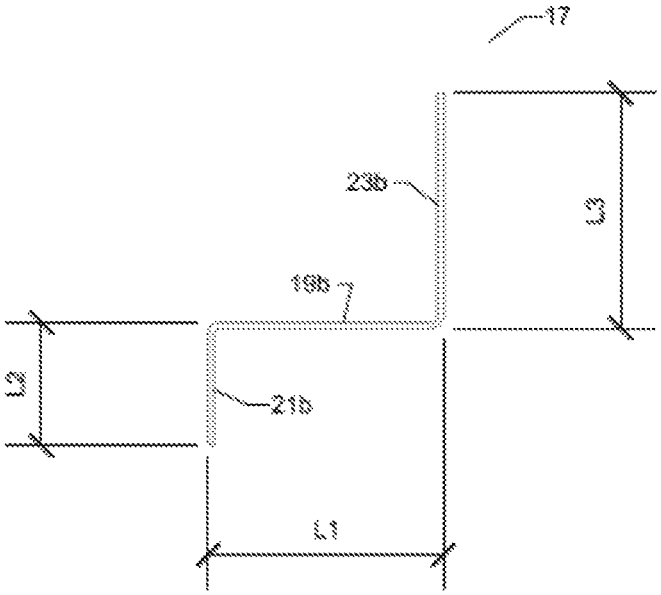
FIG. 5*b* is a cross-sectional view of another embodiment of a furring member in accordance with the present invention.
Figure 12:
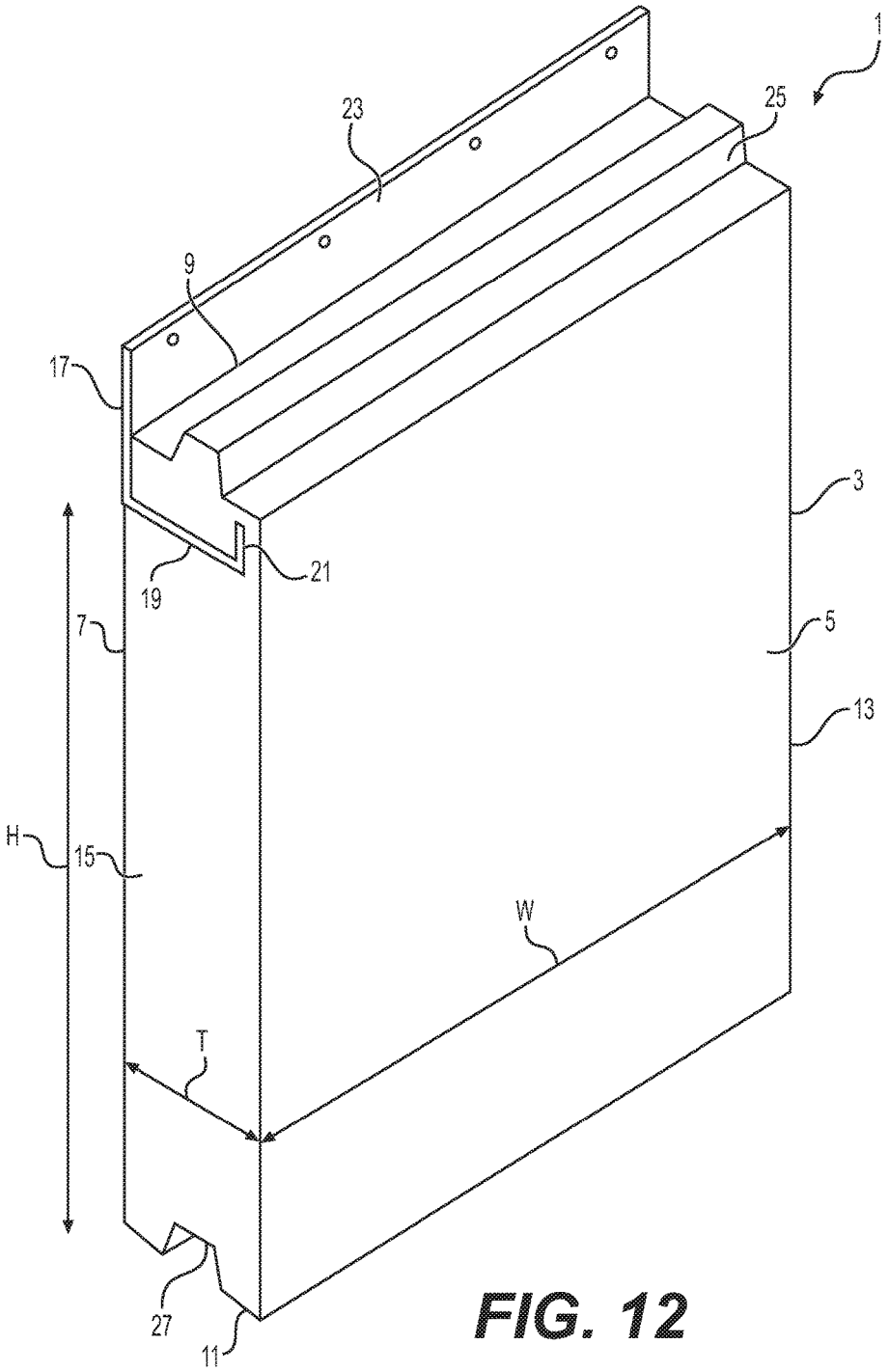
FIG. 12 is a perspective view of an alternative embodiment of the building panel of FIG. 1.

As shown in FIGS. 5*a* and 5*b*, the length l1 of the bottom portion 19 may be substantially equal to the thickness T of the central body 3 in FIG. 1 such that the first side portion 21*a*, 21*b* extends along the first face 5 of the central body 3 and the second side portion 23 extends along the second face 7 of the central body 3. Alternatively, the length $l_1$ of the bottom portion 19 may be less than the thickness T of the central body 3 such that the first side portion 21*a*, 21*b* is embedded in the central body 3 behind the first face 5 of the central body 3 and the second side portion 23 extends along the second face 7 of the central body 3. FIG. 12 similarly shows first side portion 21 embedded in the central body 3, behind the first face 5 thereof, and the second side portion 23 extending along the second face 7 of central body 3.

The length $l_1$ of bottom portion 19 may be about 1.50 to 6.00 inches, in some cases 2.50 to 3.00 inches, and in other cases 1.5 to 4.00. The length $l_2$ of the first side portion 21*a*, 21*b* may be about 1.25 to 3.00 inches and in some cases 1.625 to 3.00 inches. The length $l_3$ of the second side portion 23 may be about 3.00 to 6.00 inches and in some cases 3.25 to 6.00 inches.

Figure 6:
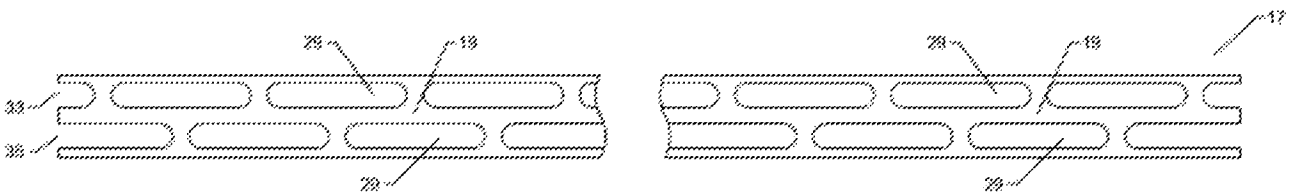
FIG. 6 is a top view of one embodiment of the bottom portion of the furring members of FIGS. 5*a* and 5*b;*

As shown in FIG. 6, the second side portion 23 of the furring member 17 extends from the bottom portion 19 of the furring member 17 beyond the top surface 9 of the central body 3 and may include a plurality of holes 31 provided along the length thereof to connect the furring member 17 to a steel stud of a building structure. These holes 31 are desirably spaced a distance d of about 4 to 24 inches apart along the length of the second side portion 23 of the furring member 17.

In FIG. 6 the expansion holes 29 are useful in that as the central body 3 is molded, the polymer matrix extends through expansion holes 29 and the expanding polymer fuses. This allows the polymer matrix to encase and hold the furring member 17 by way of the fusion in the expanding polymer.

In FIG. 6, in one embodiment, the expansion holes 29 are useful in that as the central body 3, is comprised of two pieces for the manufacturing process, one piece above the furring member and one part below the furring member 14, and the central body pieces and the furring member 17 are adhered to one another with an adhesive, where the adhesive extends through the expansion holes 29. This allows the central body 3 pieces and the furring member 17 to be joined together to create the composite panel.

Figure 7A:
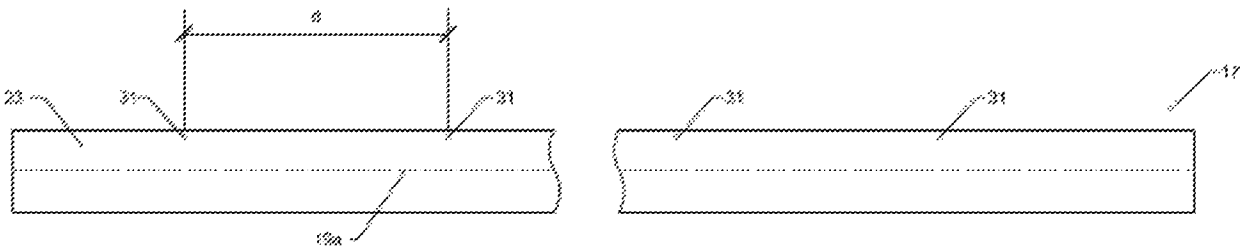
FIG. 7*a* is a rear view of the second side portion of the furring members of FIG. 5*a* and FIG. 7*b* is a rear view of the second side portion of the furring members of FIG. 5*b;*
Figure 7B:
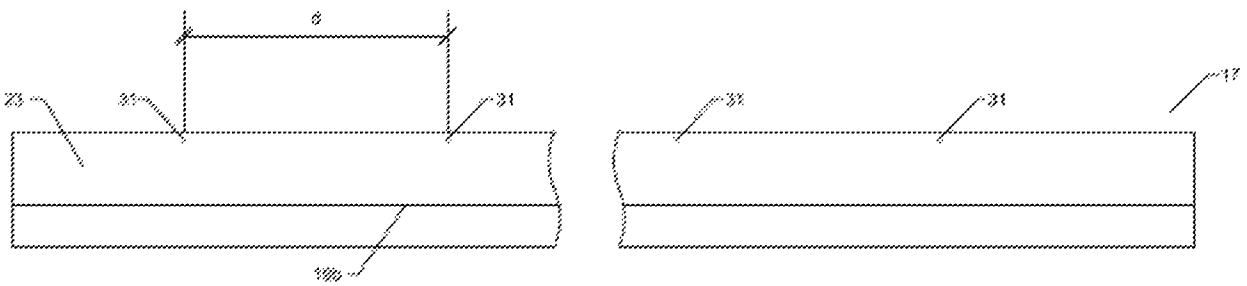

In one embodiment, as shown in FIG. 7, the bottom portion 19 of furring member 17 may comprise a first row 33 of equally spaced, elongated or oval expansion holes 29 and a second row 35 of equally spaced, elongated or oval expansion holes 29. Each row 33, 35 extends along a length of the bottom portion 19. The second row 35 of equally spaced, elongated or oval expansion holes 29 may be offset with respect to the first row 33 of equally spaced, elongated or oval expansion holes 29. By having the rows 33, 35 of the expansion holes 29 offset, thermal bridging of the panel 1 is minimized. Each hole of each row 33, 35 of elongated or oval expansion holes 29 may have a length of about 0.5 to 6 inches and a width of about 0.5 to 2 inches.

Figure 8:
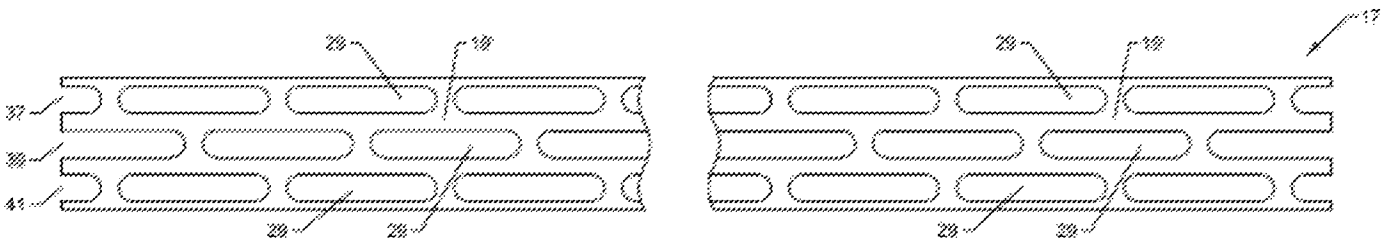
FIG. 8 is a top view of a second embodiment of the bottom portion of the furring members of FIGS. 5*a* and 5*b;*

In another embodiment, as shown in FIG. 8, the bottom portion 19' of furring member 17' may comprise a first row 37 of equally spaced, elongated or oval expansion holes 29, a second row 39 of equally spaced, elongated or oval expansion holes 29, and a third row 41 of equally spaced, elongated or oval expansion holes 29. Each row 37, 39, 41 extends along a length of the bottom portion 19'. The second row 39 of equally spaced, elongated or oval expansion holes 29 may be offset with respect to the first and third rows 37, 41 of equally spaced, elongated or oval expansion holes 39. By having the rows 37, 39, 41 of the expansion holes 19 offset, thermal bridging of the panel 1 is minimized. Each hole of each row 37, 39, 41 of elongated or oval expansion holes 29 may have a length of about 0.5 to 6 inches and a width of about 0.5 to 2 inches.

Figure 9:
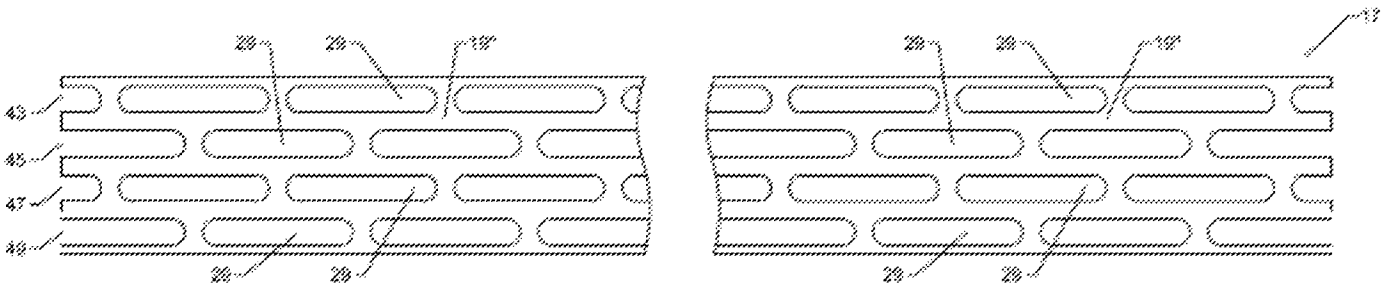
FIG. 9 is a top view of a third embodiment of the bottom portion of the furring members of FIGS. 5*a* and 5*b;*
Figure 14:
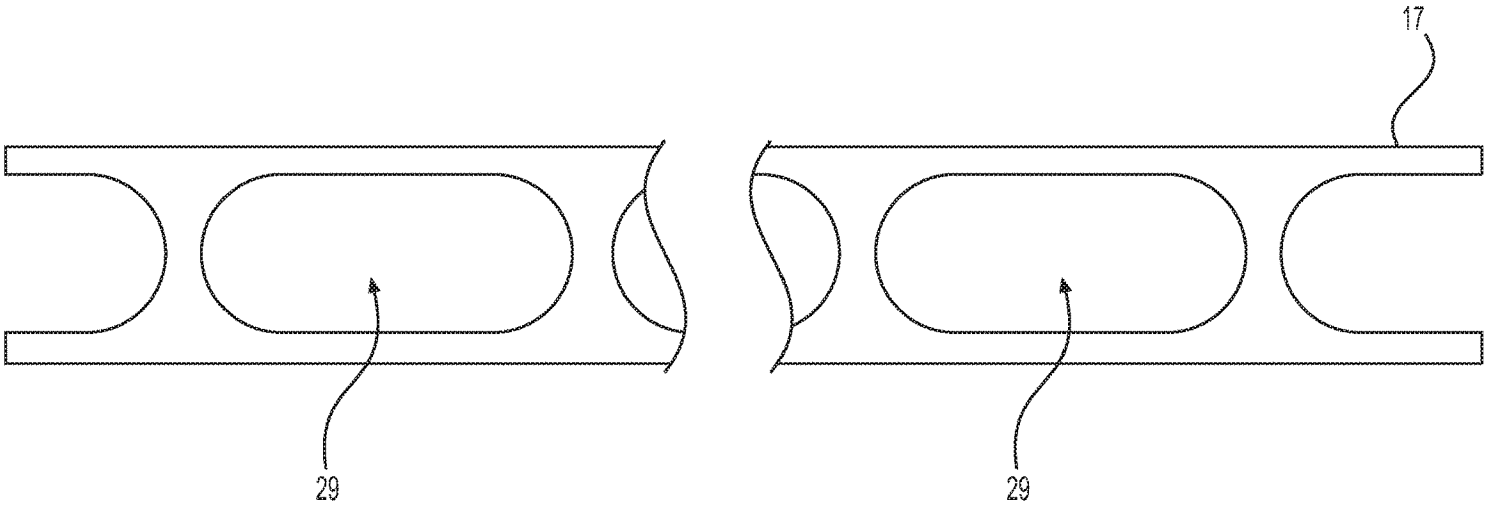
FIG. 14 is a top view of an alternative embodiment of the bottom portion of the furring members of FIGS. 5*a* and 5*b*.

In another embodiment, as shown in FIG. 9, the bottom portion 19" of furring member 17" may comprise a first row 43 of equally spaced, elongated or oval expansion holes 29, a second row 45 of equally spaced, elongated or oval expansion holes 29, a third row 47 of equally spaced, elongated or oval expansion holes 29, and a fourth row 49 of equally spaced, elongated or oval expansion holes 29. Each row 43, 45, 47, 49 extends along a length of the bottom portion 19". The second and fourth rows 45, 49 of equally spaced, elongated or oval expansion holes 29 may be offset with respect to the first and third rows 43, 47 of equally spaced, elongated or oval expansion holes 29. By having the rows 43, 45, 47, 49 of the expansion holes 29 offset, thermal bridging of the panel 1 is minimized. Each hole of each row 43, 45, 47, 49 of elongated or oval expansion holes 29 may have a length of about 0.5 to 6 inches and a width of about 0.5 to 2 inches. FIG. 14 shows the bottom portion of furring member 17 with a single row of similar equally spaced, elongated or oval expansion holes 29.

While the expansion holes 29 have been described hereinabove as being elongated or oval, the expansion holes may be configured in a variety of different manners, sizes and shapes including those discussed hereinabove as well as those described for use with the reinforcing members in U.S. patent application Ser. No. 11/361,715, which is hereby incorporated by reference in its entirety.

Figure 10:
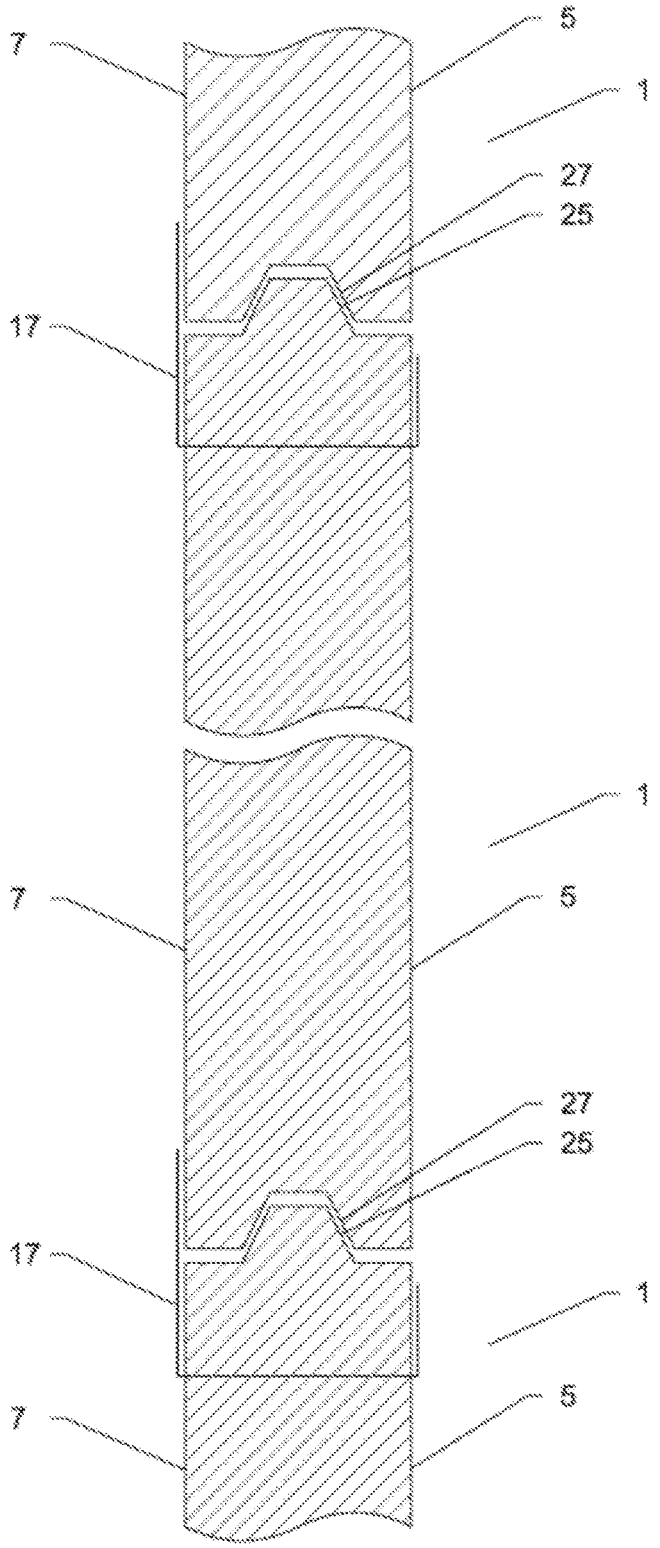
FIG. 10 is a side view of the building panel of FIG. 1 connected to corresponding building panels at the top and bottom thereof.
Figure 11:
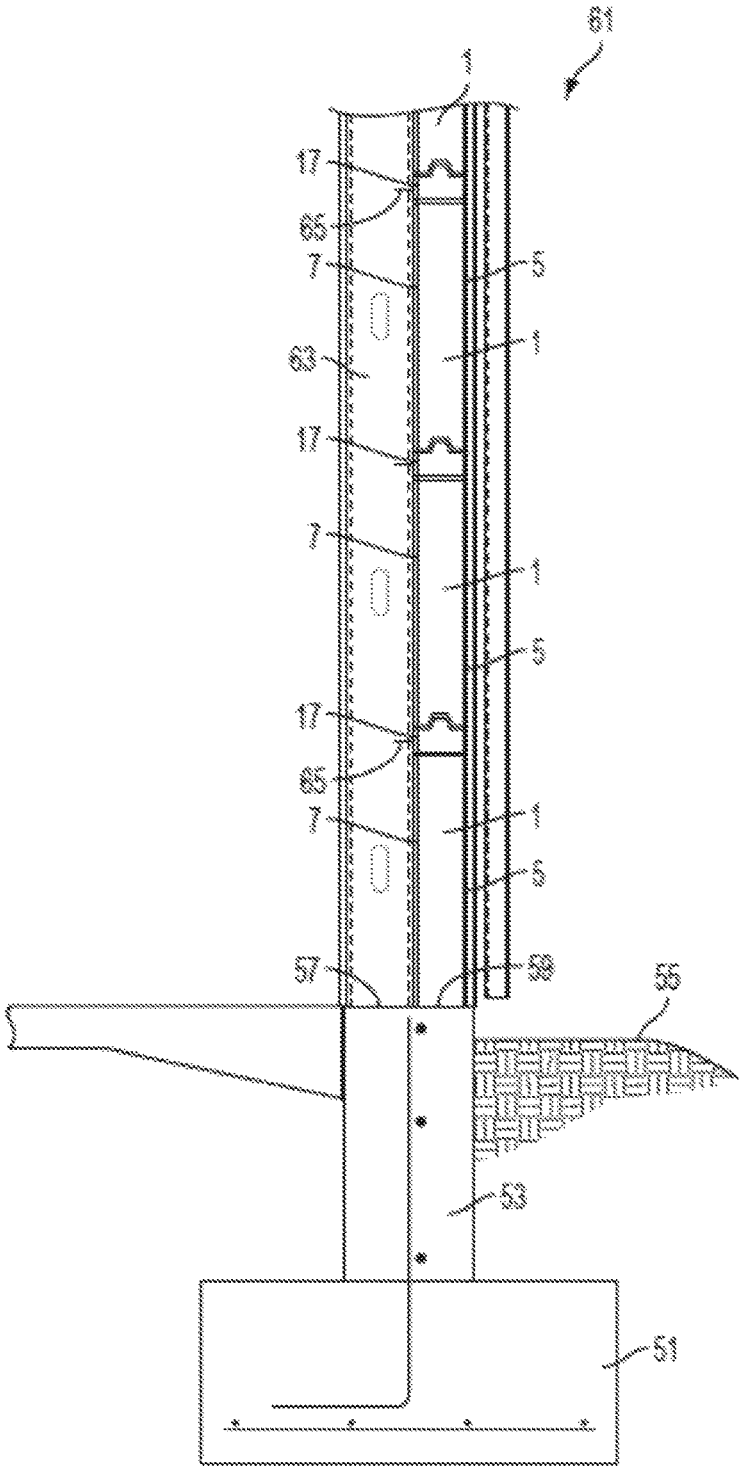
FIG. 11 is a side view of a building structure erected using the building panels of FIG. 1.

With reference to FIGS. 10 and 11, the walls of a building are constructed with the panel 1 as follows. First, a concrete footing 51 having a series of concrete foundation walls 53 is provided within a ground surface 55. Each of the foundation walls 53 has a top surface 57 upon which a furring base track and anchorage 59 is provided. The furring base track and anchorage 59 is configured to receive a first one of the panels 1 and securely couple the panel 1 to the top surface 57 of the foundation wall(s) 53.

Figure 13:
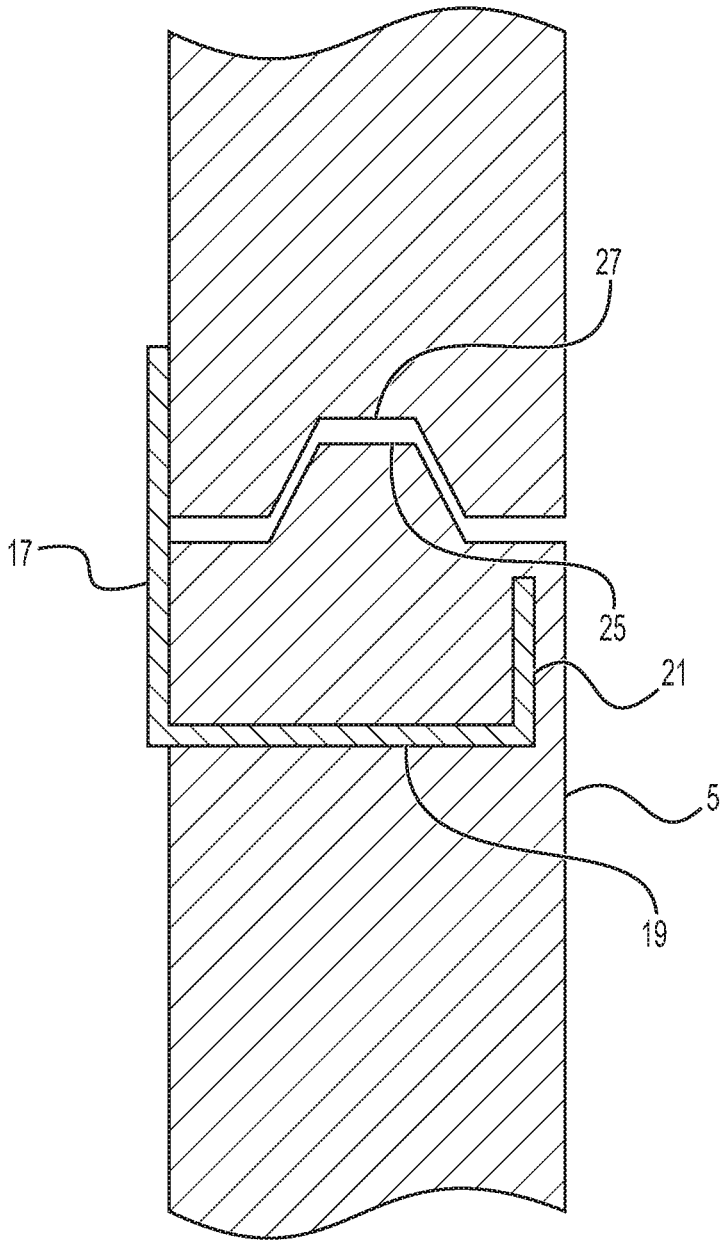
FIG. 13 is a partial side view of the building panel of FIG. 12 connected to corresponding building panels at the top thereof.

Metal studs 63 are anchored to the top surface 57 of the foundation wall(s) 53. one panel 1 is then inserted into the a furring base track and anchorage 59 and the second side portion 23 of the furring member 17 of each of the panel 1 are connected to the metal studs 63. Any suitable fastener 65 may be used to connect the second side portion 23 of the furring members 17. Such fasteners include, but are not limited to, fasteners that pass through holes 31 provided along the length of the second side portion 23 and self-drilling or self-tapping fasteners that directly connect the second side portion 23 to the metal studs 23 without any holes being provided in the second side portion 23. Similar to that shown in FIG. 12, FIG. 13 shows first side portion 21 of furring member 17 embedded in the central body, behind the first face 5 thereof.

Further panels 1 are then stacked on top of each other such that the male tongue end 25 on the top surface 9 of the panel 1 engages the female groove end 27 on the bottom surface 11 of the panel 1 that is positioned thereon until a desired height of a combined composite building panel 61 is reached.

A finishing material 67 may then be applied to the first faces 5 of the plurality of composite building panels 1. Non-limiting examples of suitable finishing materials include wood, rigid plastics, wood paneling, concrete panels, cement panels, drywall, sheetrock, particle board, rigid plastic panels, a metal lath, masonry and/or stone venner, metal panels, or any other suitable material having decorating and/or structural functions.

While specific embodiments of the device of the present disclosure have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the device of the present disclosure which is to be given the full breadth of the claims appended and any and all equivalents thereof.

In one embodiment of the invention as part of the manufacturing process a facing may be added to the first face 5. The facing may consist of a weather barrier coating or similar material to improve the thermal characteristics, air or moisture permeability, or vapor penetration and/or provide characteristics of a weather barrier.

The invention claimed is:

1. A composite building panel that provides insulation while also reducing thermal bridging and provides positive attachment for the cladding in a highly constructible method with high labor productivity comprising:

a central body comprised of an expanded polymer matrix having a first face and an opposing second face, a top surface and an opposing bottom surface, and a first side surface and an opposing second side surface; and a furring member extending horizontally across the central body between the first side surface and the second side surface proximate to the top surface, the furring member comprising:

a bottom portion having at least one expansion hole such that the expanded polymer matrix extends therethrough, thereby embedding the bottom portion in the expanded polymer matrix;

a first side portion extending perpendicularly from the bottom portion, wherein the first side portion extends along, and is coplanar with respect to, the first face of the central body; and a second side portion extending perpendicularly from the bottom portion, wherein the second side portion extends along, and is coplanar with respect to, the second face of the central body, the first and second side portions each extending in the same direction, wherein the central body comprises first and second pieces for the manufacturing process, the first piece being positioned above the bottom portion of the furring member and the second piece being positioned below the bottom portion of the furring member, and the first and second pieces of the central body and the furring member being adhered to one another with adhesive, where the adhesive extends through the expansion holes allowing the central body pieces and the furring member to be joined together to create the composite panel, wherein at least one of the first side portion and the second side portion of the furring member extends from the bottom portion of the furring member beyond the top surface of the central body, and the composite building panels with an integral furring member provide insulation while also reducing thermal bridging and provide positive attachment for the cladding in a highly constructible method with high labor productivity.

2. The composite building panel according to claim 1, wherein the first side portion and the second side portion extend in directions that are substantially parallel to one another and the bottom portion extends in a direction that is substantially perpendicular to the directions in which the first side portion and the second side portion extend.

3. The composite building panel according to claim 2, wherein the first side portion extends away from the bottom portion in a direction that is substantially the same as the direction in which the second side portion extends away from the bottom portion.

4. The composite building panel according to claim 2, wherein the first side portion extends away from the bottom portion in a direction that is substantially opposite to the direction in which the second side portion extends away from the bottom portion.

5. The composite building panel according to claim 1, wherein the top surface of the central body comprises one of a groove and a projection and the bottom surface comprises one of a complimentary groove and a complimentary projection that facilitates a groove and projection union between a first central body and a second central body to form one or more combined composite building panels.

6. The composite building panel according to claim 1, wherein the at least one expansion hole has an oval shape.

7. The composite building panel according to claim 1, wherein the bottom portion of the furring member comprises a plurality of expansion holes.

8. The composite building panel of claim 7, wherein the plurality of expansion holes are positioned along the length of the bottom portion of the furring member and comprise a first row of equally spaced, elongated holes and a second row of equally spaced, elongated holes.

9. The composite building panel of claim 7, wherein the plurality of expansion holes are positioned along the length of the bottom portion of the furring member and comprise a first row of equally spaced, elongated holes, a second row of equally spaced, elongated holes and a third row of equally spaced, elongated holes.

10. The composite building panel of claim 9, wherein the holes of the second row are offset with respect to the holes of the first and third rows.

11. The composite building panel of claim 7, wherein the plurality of expansion holes are positioned along the length of the bottom portion of the furring member and comprise a first row of equally spaced, elongated holes; a second row of equally spaced, elongated holes; a third row of equally spaced, elongated holes; and a fourth row of equally spaced, elongated holes.

12. The composite building panel according to claim 11, wherein the holes of the second and fourth rows are offset with regard to the holes of the first and third rows.

13. The composite building panel according to claim 1, wherein the at least one of the first side portion and the second side portion of the furring member that extends from the bottom portion of the furring member beyond the top surface of the central body may include a plurality of holes provided along the length thereof.

14. A composite building panel according to claim 1, wherein the expanded polymer matrix comprises one or more polymers selected from the group consisting of homopolymers of vinyl aromatic monomers; copolymers if at least one vinyl aromatic monomer with one or more of divinyl benzene, conjugated dienes, alkyl methacrylates, alkyl acrylates, acrylonitrile, and/or maleic anhydride; polyolefins; polycarbonates; and combinations thereof.

15. A composite building panel according to claim 1, wherein the central body and the furring member are adhered to one another by a thermoset resin, wherein the thermoset resin is selected from the group consisting of alkyd resins, epoxy resins, diallyl phthalate resins, melamine resins, phenolic resins, polyester resins, urethane resins, urea, and crosslinkings thereof with reactants, the reactants being selected from the group consisting of diols, triols, polyols, formaldehyde, and combinations thereof.

16. A method of constructing a building comprising:

providing a foundation having a series of foundation walls having top surfaces;

providing metal studs extending from the top surfaces of the foundation walls;

providing a plurality of composite building panels, each of the panels comprising:

a central body comprised of an expanded polymer matrix having a first face and an opposing second face, a top surface and an opposing bottom surface, and a first side surface and an opposing second side surface; and a furring member extending horizontally across the central body between the first side surface and the second side surface proximate to the top surface, the furring member comprising:

a bottom portion having at least one expansion hole such that the expanded polymer matrix extends therethrough, thereby embedding the bottom portion in the expanded polymer matrix;

a first side portion extending perpendicularly from the bottom portion, wherein the first side portion extends along, and is coplanar with respect to, the first face of the central body; and a second side portion extending perpendicularly from the bottom portion, wherein the second side portion extends along, and is coplanar with respect to, the second face of the central body, the first and second side portions each extending in the same direction;

wherein at least one of the first side portion and the second side portion of the furring member extends from the bottom portion of the furring member beyond the top surface of the central body; and stacking the plurality of composite building panels on top of each other on at least some of the top surfaces of the foundation walls until a desired height of a combined composite building panel is reached, wherein at least one of the first side portion and the second side portion of each of the furring members that extend from the bottom portion of the furring member beyond the top surface of the central body are connected to at least one of the plurality of studs using fasteners.

17. The method according to claim 16, wherein the at least one of the first side portion and the second side portion of the furring member that extends from the bottom portion of the furring member beyond the top surface of the central body includes a plurality of holes provided along the length thereof.

18. The method according to claim 16, wherein the top surface of the central body of each of the plurality of composite building panels comprises one of a groove and a projection and the bottom surface comprises one of a complimentary groove and a complimentary projection that facilitates a groove and projection union between a first central body and a second central body to form the combined composite building panel.

* * * * *